US009287655B2

(12) United States Patent
Sato et al.

(10) Patent No.: US 9,287,655 B2
(45) Date of Patent: Mar. 15, 2016

(54) CRIMPED TERMINAL ATTACHED ALUMINUM ELECTRIC WIRE

(71) Applicant: Yazaki Corporation, Minato-ku, Tokyo (JP)

(72) Inventors: Kei Sato, Makinohara (JP); Nobuyuki Asakura, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/609,673

(22) Filed: Jan. 30, 2015

(65) Prior Publication Data

US 2015/0140856 A1 May 21, 2015

Related U.S. Application Data

(63) Continuation of application No. PCT/JP2013/070635, filed on Jul. 30, 2013.

(30) Foreign Application Priority Data

Jul. 31, 2012 (JP) ..... 2012-169792

(51) Int. Cl.
*H01R 13/52* (2006.01)
*H01R 4/18* (2006.01)
(Continued)

(52) U.S. Cl.
CPC ..... *H01R 13/5221* (2013.01); *H01R 4/183* (2013.01); *H01R 4/70* (2013.01); *H01R 43/005* (2013.01); *H01R 4/185* (2013.01); *H01R 4/62* (2013.01)

(58) Field of Classification Search
CPC .... H01R 4/185; H01R 4/183; H01R 13/5221; H01R 4/70
See application file for complete search history.

(56) References Cited

U.S. PATENT DOCUMENTS 2,379,567 A * 7/1945 Buchanan ..... H01R 4/206 439/868
2,758,491 A * 8/1956 Buchanan ..... H01R 43/058 29/753

(Continued)

FOREIGN PATENT DOCUMENTS

JP S5842951 B2 9/1983
JP 2003-187642 A 7/2003

(Continued)

OTHER PUBLICATIONS

Feb. 3, 2015—International Preliminary Report on Patentability—Intl App PCT/JP2013/070635.

(Continued)

*Primary Examiner* — Briggitte R Hammond
(74) *Attorney, Agent, or Firm* — Banner & Witcoff, Ltd.

(57) ABSTRACT

A crimped terminal attached aluminum electric wire includes an aluminum electric wire that includes a conductor part made of aluminum or aluminum alloy and an insulative coating part which surrounds the periphery of the conductor part, and a crimped terminal that is crimped to the conductor part which is exposed by removing the insulative coating part at an end of the aluminum electric wire. The crimped terminal includes a conductor crimping part which is crimped to the exposed conductor part, and an end side conductor crimping part which is formed at an end at the side of the crimped terminal to which the aluminum electric wire is connected, and which is crimped to the conductor part at a radial compression rate which is smaller than that at which the conductor part is crimped by the conductor crimping part.

8 Claims, 10 Drawing Sheets

(51) Int. Cl.

| | |
|---|---|
| ***H01R 4/70*** | (2006.01) |
| ***H01R 43/00*** | (2006.01) |
| *H01R 4/62* | (2006.01) |

(56) References Cited

U.S. PATENT DOCUMENTS

| | | | | | |
|---|---|---|---|---|---|
| 2,815,497 | A * | 12/1957 | Redslob | H01R 4/62 | 439/879 |
| 2,868,863 | A * | 1/1959 | Cook | H01R 4/62 | 439/894 |
| 3,243,758 | A * | 3/1966 | Frant | H01R 4/18 | 439/882 |
| 3,955,044 | A * | 5/1976 | Hoffman | H01R 4/62 | 174/84 C |
| 5,418,331 | A * | 5/1995 | Delalle | H01R 4/22 | 174/74 R |
| 7,174,633 | B2 * | 2/2007 | Onuma | H01R 4/04 | 29/854 |
| 7,905,755 | B1 * | 3/2011 | Martauz | H01R 4/184 | 439/886 |
| 7,954,235 | B2 * | 6/2011 | Martauz | H01R 4/184 | 174/84 C |
| 8,641,461 | B2 * | 2/2014 | Mitose | H01R 4/185 | 439/587 |
| 2002/0034898 | A1 * | 3/2002 | Kuwayama | H01R 4/185 | 439/877 |
| 2006/0292922 | A1 * | 12/2006 | Froschl | H01R 4/023 | 439/442 |
| 2010/0003867 | A1 * | 1/2010 | Lehmann | H01R 4/187 | 439/874 |
| 2011/0070781 | A1 * | 3/2011 | Kitagawa | H01R 4/185 | 439/877 |
| 2011/0225820 | A1 * | 9/2011 | Kondo | H01R 4/185 | 29/863 |
| 2012/0324727 | A1 * | 12/2012 | Seifert | H01R 4/187 | 29/867 |
| 2013/0252459 | A1 | 9/2013 | Tanaka et al. | | |

FOREIGN PATENT DOCUMENTS

| | | | |
|---|---|---|---|
| JP | 2004-207172 | A | 7/2004 |
| JP | 2007-311369 | A | 11/2007 |
| JP | 2009-245807 | A | 10/2009 |
| JP | 2011-192586 | A | 9/2011 |
| JP | 2012-084479 | A | 4/2012 |
| JP | 2012-094340 | A | 5/2012 |
| JP | 2012-129178 | A | 7/2012 |
| WO | 2011-115005 | A1 | 9/2011 |

OTHER PUBLICATIONS

Oct. 29, 2013—International Search Report—Intl App PCT/JP2013/070635.

Dec. 1, 2015—(JP) Notification of Reasons for Refusal—App 2012-169792.

* cited by examiner

CRIMPED TERMINAL ATTACHED ALUMINUM ELECTRIC WIRE

CROSS REFERENCE TO RELATED APPLICATIONS

This application is a continuation of PCT application No. PCT/JP2013/070635, which was filed on Jul. 30, 2013 based on Japanese Patent Application (No. 2012-169792) filed on Jul. 31, 2012, the contents of which are incorporated herein by reference.

BACKGROUND OF THE INVENTION

1. Field of the Invention

The present invention relates to a crimped terminal attached aluminum electric wire.

2. Description of the Related Art

Traditionally, a crimped terminal attached electric wire in which a crimped terminal is crimped to a conductor part is used as a terminal attached electric wire which is used in a wire harnesses which is wired in a vehicle.

In recent years, in the automotive industry, in consideration of environment it becomes an important object to improve mileage by lightweighting a vehicle. Therefore, a crimped terminal attached aluminum electric wire in which a conductor part made of aluminum or aluminum alloy, which is lighter than copper, is used attracts attention.

However, because aluminum is easy to corrode in the presence of water and copper ions, there is a problem which is that when water invades the portion where the conductor part made of aluminum or aluminum alloy and the crimped terminal made of copper are connected, corrosion is easy to occur.

Thus, to prevent the corrosion of the conductor part by preventing adhesion of the water to the conductor part, crimped terminal attached aluminum electric wires are described in a patent document 1 and a patent document 2 for which the exposed conductor part is covered with a cap made of metal.

Patent document 1: JP-A-2007-311369

Patent document 2: WO/2011/115005

SUMMARY OF THE INVENTION

However, for the crimped terminal attached aluminum electric wire described in the patent document 1, to waterproofably seal the opening end of the cap, resin in which metal powder is mixed must be filled in the cap, and electrical resistance might increase because the resin is between the crimped terminal and the conductor part.

On the other hand, for the crimped terminal attached aluminum electric wire described in the patent document 2, it is necessary to block up the opening end of the cap with a sealing body, and the size of the crimped terminal attached aluminum electric wire in the radially outward direction of the electric wire is increased due to the seal body. Therefore, it is necessary to make the size of a receiving part of a connector housing in which the crimped terminal attached aluminum electric wire is received correspond to the increased size due to the seal body, and there is a problem which is that versatility is bad.

The present invention is made in view of the above situations, and an object of the present invention is to provide a crimped terminal attached aluminum electric wire for which the conductor part is waterproofably sealed in a crimped terminal without increasing electrical resistance and there is versatility.

(1) A crimped terminal attached aluminum electric wire includes an aluminum electric wire that includes a conductor part made of aluminum or aluminum alloy and an insulative coating part which surrounds the periphery of the conductor part, and a crimped terminal that is crimped to the conductor part which is exposed by removing the insulative coating part at an end of the aluminum electric wire. The crimped terminal includes a conductor crimping part which is crimped to the exposed conductor part, and an end side conductor crimping part which is formed at an end at the side of the crimped terminal to which the aluminum electric wire is connected, and which is crimped to the conductor part at a radial compression rate which is smaller than that at which the conductor part is crimped by the conductor crimping part. A gap between the crimped terminal and the insulative coating part in the extending direction of the aluminum electric wire is surrounded by a pipe-like elastic sealing member along the circumferential direction of the aluminum electric wire, and a gap of the crimped terminal which is crimped to the aluminum electric wire is sealed by a sealant.

(2) In the crimped terminal attached aluminum electric wire of (1), the end side conductor crimping part is crimped to the conductor part so that the outer circumferential surface of the end side conductor crimping part becomes flush with the outer circumferential surface of the insulative coating part.

(3) In the crimped terminal attached aluminum electric wire of (1) or (2), the pipe-like elastic sealing member has a gap fitted protrusion which is protruded from the pipe inner surface to be fitted into the gap between the crimped terminal and the insulative coating part in the extending direction of the aluminum electric wire.

(4) In the crimped terminal attached aluminum electric wire of (1) or (2), the pipe-like elastic sealing member is formed with a plurality of lips which are protruded along the pipe inner circumferential surface from the pipe inner surface into a mountain-like shape in section to reduce the pipe inner diameter.

(5) In the crimped terminal attached aluminum electric wire of (1) or (2), the end side conductor crimping part is connected integrally with the conductor crimping part along the extending direction of the aluminum electric wire without being separated by a gap from the conductor crimping part.

For the crimped terminal attached aluminum electric wire described in the above (1), the level difference between the end side conductor crimping part and the insulative coating part is decreased, the gap between the crimped terminal and the insulative coating part in the extending direction of the aluminum electric wire is elastically adhered and covered by the pipe-like elastic sealing member, and the gap of the crimped terminal is sealed by the sealant. Thereby, the conductor part is waterproofably sealed inside the crimped terminal, and the conductor crimping part is crimped to the exposed conductor part. Thus, for the crimped terminal attached aluminum electric wire in the above (1), the crimped terminal is connected to the conductor part without increasing electrical resistance, and since the crimped terminal only includes a part that directly contact the conductor part not through the insulative coating part, the size of the crimped terminal attached aluminum electric wire in the radially outward direction is prevented from increasing, and it is not necessary to set the size of a receiving part of the connector housing where the crimped terminal attached aluminum electric wire is received to be big. Thus, as a result, the conductor part is waterproofably sealed inside the crimped terminal without increasing electrical resistance, and there is versatility.

For the crimped terminal attached aluminum electric wire described in the above (2), since the level difference between the end side conductor crimping part and the insulative coating part is controlled as small as possible, it becomes easy for the pipe-like elastic sealing member to be adhered to the crimped terminal and the insulative coating part. Thus, waterproofing performance of the pipe-like elastic sealing member can be further improved.

For the crimped terminal attached aluminum electric wire described in the above (3), when the gap fitted protrusion is fitted in the gap, the gap fitted protrusion is caught and the pipe-like elastic sealing member is fixed at a predetermined position of the crimped terminal attached aluminum electric wire, and since the gap is filled by the gap fitted protrusion, water is surely prevented from invading from the gap. Further, even if a bending force is acted when the crimped terminal attached aluminum electric wire is assembled to a connector housing, the conductor part is hard to be bent from the gap as a starting point. Therefore, positioning performance, fixing performance, waterproofing performance, and protecting performance against a mechanical external force to the conductor part of the pipe-like elastic sealing member can be improved.

For the crimped terminal attached aluminum electric wire described in the above (4), since the lips are formed, the waterproofing performance of the pipe-like elastic sealing member can be improved.

For the crimped terminal attached aluminum electric wire described in the above (5), since the end side conductor crimping part is connected integrally with the conductor crimping part along the extending direction of the aluminum electric wire without being separated by a gap from the conductor crimping part, the waterproofing performance of the crimped terminal can be further improved.

The preferred embodiments of the crimped terminal attached aluminum electric wire according to the present invention are described in detail with reference to the figures as follows.

DETAILED DESCRIPTION OF THE EXEMPLARY EMBODIMENTS

Embodiments

Figure 1:
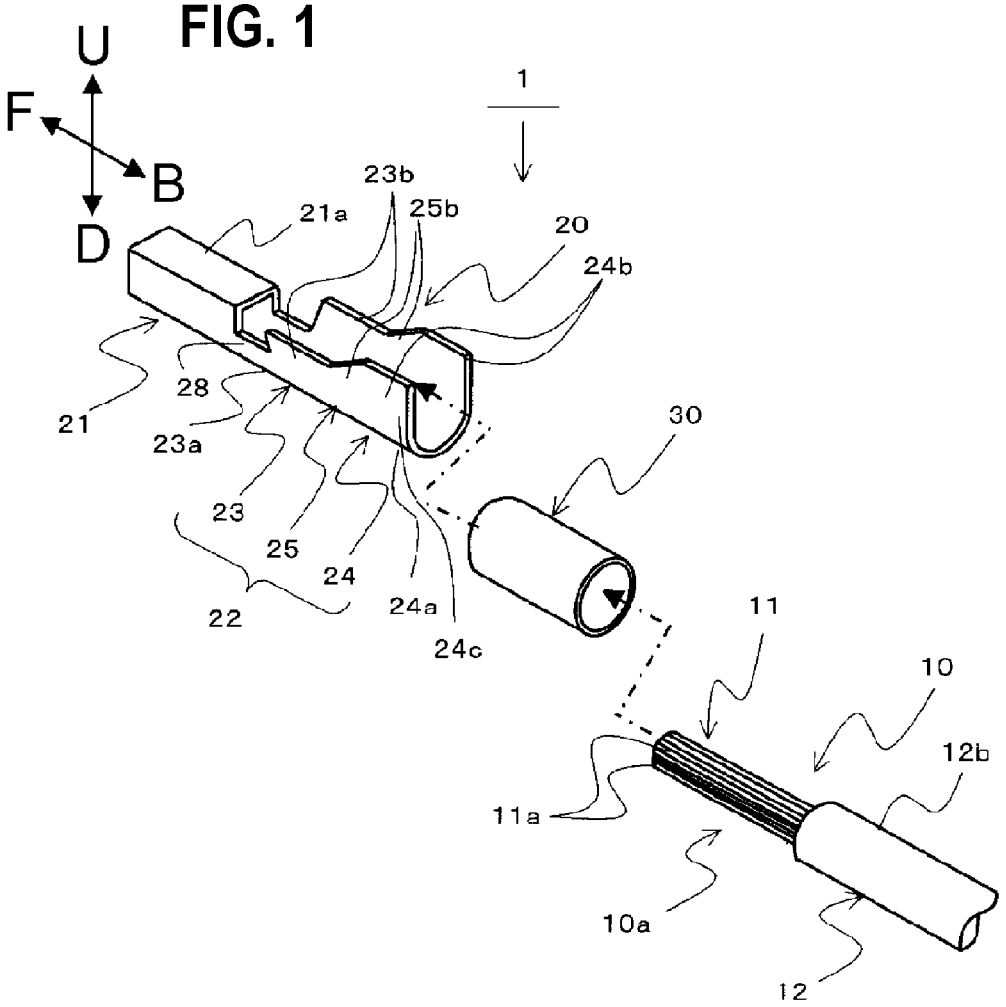
FIG. 1 is an exploded perspective view of a crimped terminal attached aluminum electric wire according to one embodiment of the present invention.
Figure 2:
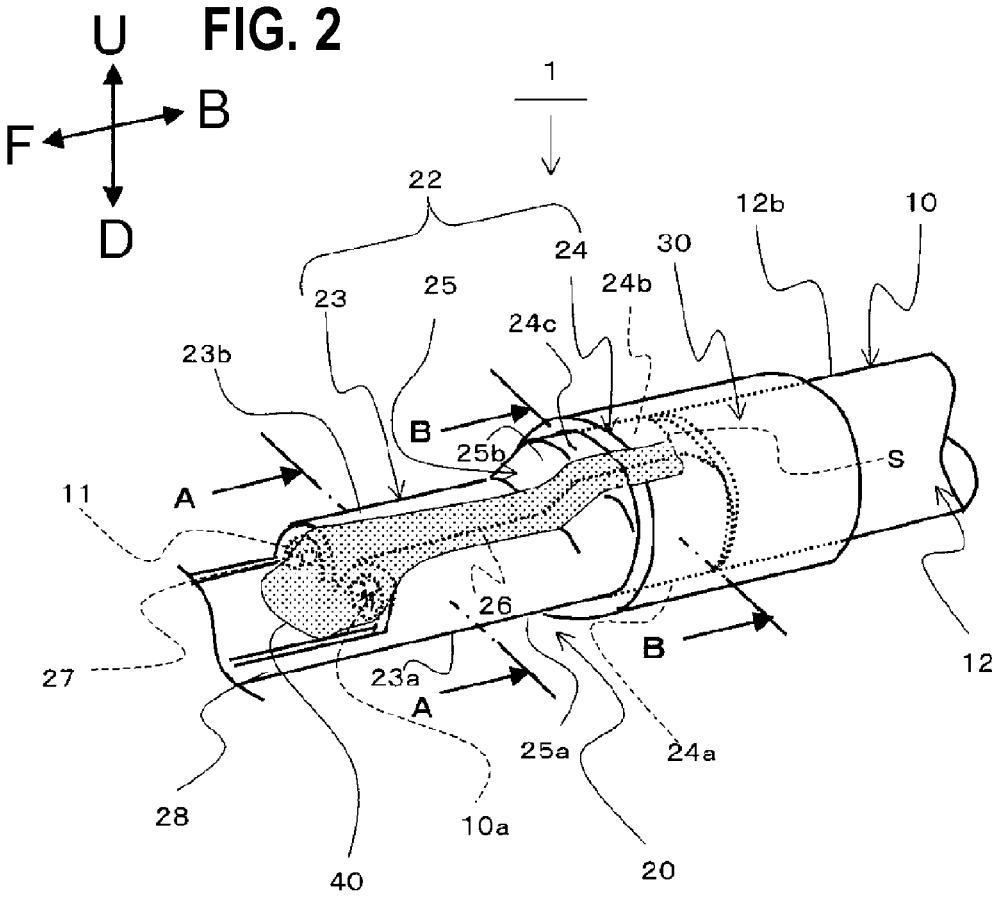
FIG. 2 is an enlarged figure around an electric wire connecting part of the crimped terminal in the crimped terminal attached aluminum electric wire shown in FIG. 1.
Figure 3:
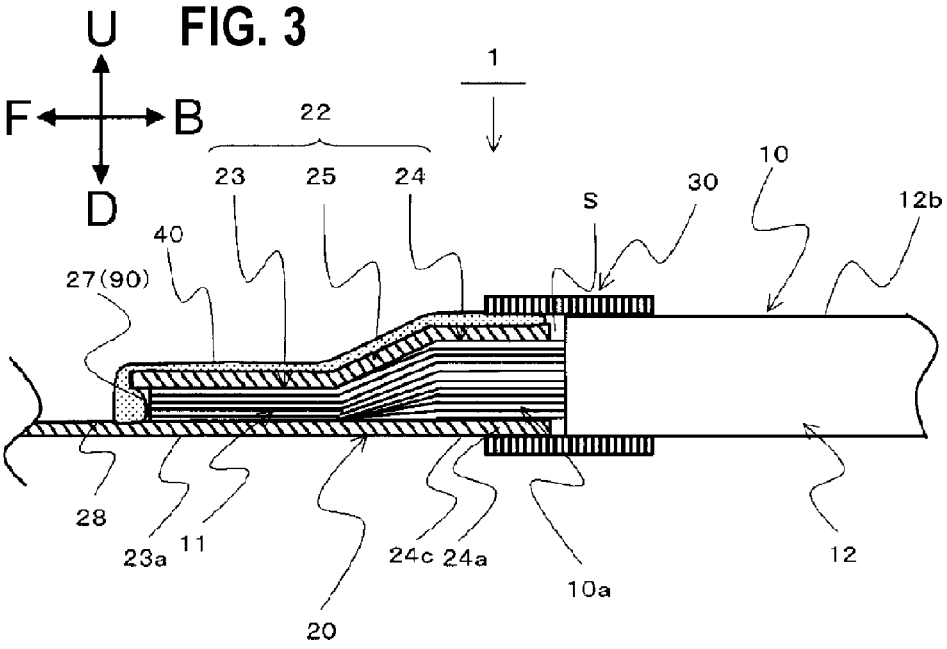
FIG. 3 is a sectional view of the crimped terminal attached aluminum electric wire shown in FIG. 2 which is viewed laterally.
Figure 4:
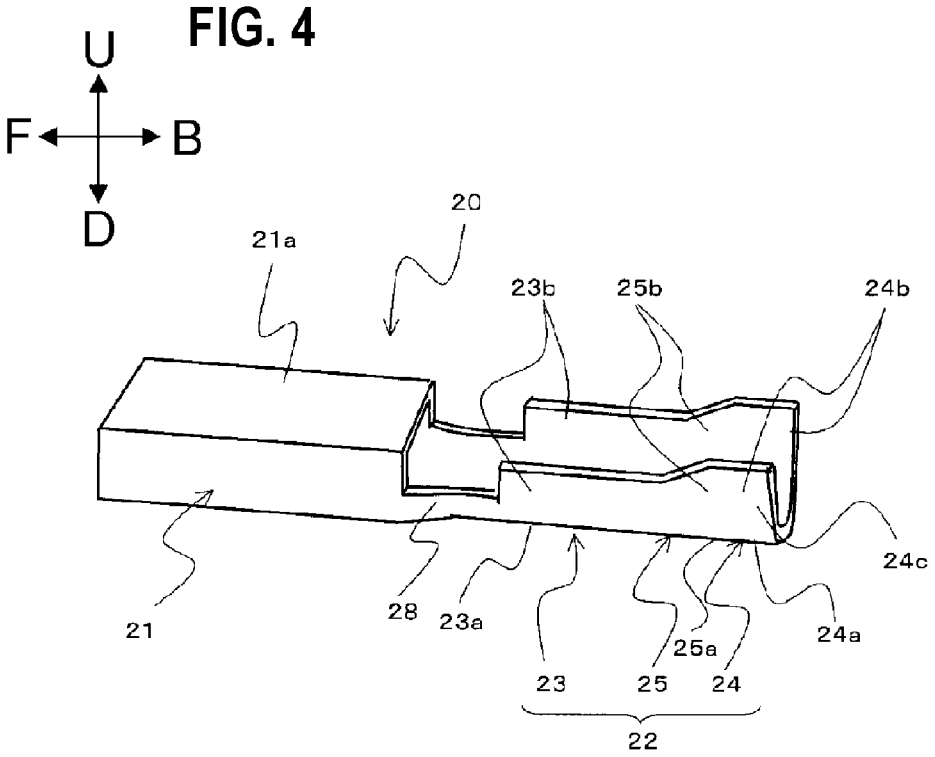
FIG. 4 is an enlarged perspective view of the crimped terminal shown in FIG. 1.

FIG. 1 is an exploded perspective view of a crimped terminal attached aluminum electric wire 1 according to an embodiment of the present invention.

A sealant 40 is omitted which is applied to a gap 90 of a crimped terminal 20 which is crimped to an aluminum electric wire 10 in FIG. 1.

The crimped terminal attached aluminum electric wire 1 according to the embodiment of the present invention has the aluminum electric wire 10, which includes a conductor part 11 made of aluminum or aluminum alloy and an insulative coating part 12 which surrounds the periphery of the conductor part 11, the crimped terminal 20 which is crimped to the conductor part 11 which is exposed by removing the insulative coating part 12 at an end 10*a* of the aluminum electric wire 10, and a pipe-like elastic sealing member 30 which surrounds a gap S, which is between the crimped terminal 20 and the insulative coating part 12 in the extending direction of the aluminum electric wire 10, along the circumferential direction of the aluminum electric wire 10, and the gap 90 of the crimped terminal 20 which is crimped to the aluminum electric wire 10 is sealed by the sealant 40.

In the embodiments of the present invention, for the convenience of description, as shown with arrows in the figure, a forward direction (F), a backward direction (B), an upward direction (U) and a downward direction (D) are defined.

First, the aluminum electric wire 10 is described.

A plurality of strands 11*a* made of aluminum or aluminum alloy are twisted to form the conductor part 11.

The insulative coating part 12 is formed of insulating synthetic resin to surround the periphery of the conductor part 11 so that the conductor part 11 is insulatively protected from the outside.

Although it is exemplified that a plurality of strands 11*a* are twisted to form the conductor part 11, the present invention is not limited to this. The conductor part 11 may be a single core line made of aluminum or aluminum alloy.

Then, the crimped terminal 20 is described.

The crimped terminal 20 is a terminal metal fitting which is molded by forging a flat board made of metal such as copper or copper alloy with a metal mold.

The crimped terminal 20 has a mating terminal connecting part 21 which becomes a connecting portion to connect with a mating terminal not shown, an electric wire connecting part 22 which becomes a connecting portion to connect with the aluminum electric wire 10, and an intermediate part 28 which is a part between the mating terminal connecting part 21 and the electric wire connecting part 22 to connect the mating terminal connecting part 21 and the electric wire connecting part 22.

The mating terminal connecting part 21 has such a construction that an elastic contact strip not shown, which the mating terminal not shown touches, is provided inside the pipe of a rectangular pipe-like connection body 21*a*.

the electric wire connecting part 22 has a conductor crimping part 23 which is crimped to the exposed conductor part 11, an end side conductor crimping part 24 which is formed at the end at the side of the crimped terminal 20 where the aluminum electric wire 10 is connected, and which is crimped to the exposed conductor part 11, and an integrally connecting part 25 which integrally ties the conductor crimping part 23 and the end side conductor crimping part 24.

Figure 5:
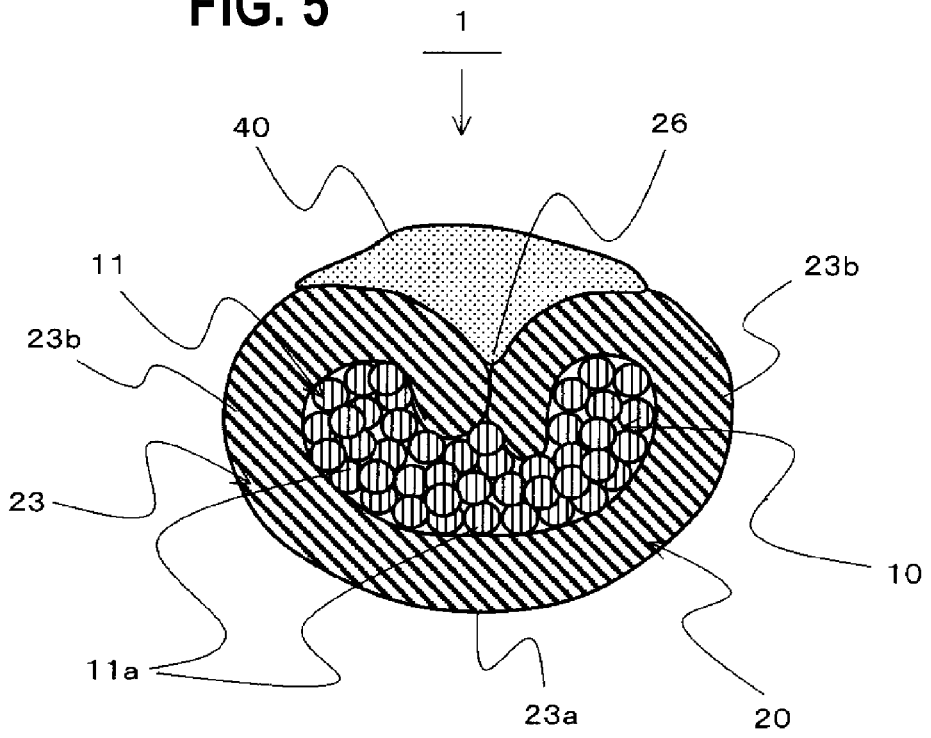
FIG. 5 is an A-A line sectional view of the crimped terminal attached aluminum electric wire shown in FIG. 2.

The conductor crimping part 23 has a conductor crimping bottom wall 23*a* on which the conductor part 11 is placed, and a pair of conductor crimping rising walls 23*b* which rise from two side edges of the conductor crimping bottom wall 23*a*, and which are crimped to surround the upper periphery of the conductor part 11 from the two sides of the conductor part 11. As shown in FIG. 5, the height of the conductor crimping rising walls 23*b* is so set that the periphery of the conductor part 11 is surrounded when the pair of upper edges of the pair of conductor crimping rising walls 23*b* become a joint. That is, the height of the conductor crimping rising walls 23*b* is set according to the diameter of the conductor part 11.

The end side conductor crimping part 24 is formed at the end at the side of the crimped terminal 20 to which the aluminum electric wire 10 is connected by being connected integrally with the conductor crimping part 23 along the extending direction of the aluminum electric wire 10 without being separated by a gap from the conductor crimping part 23, and is a part which is crimped to the exposed conductor part 11.

Figure 6:
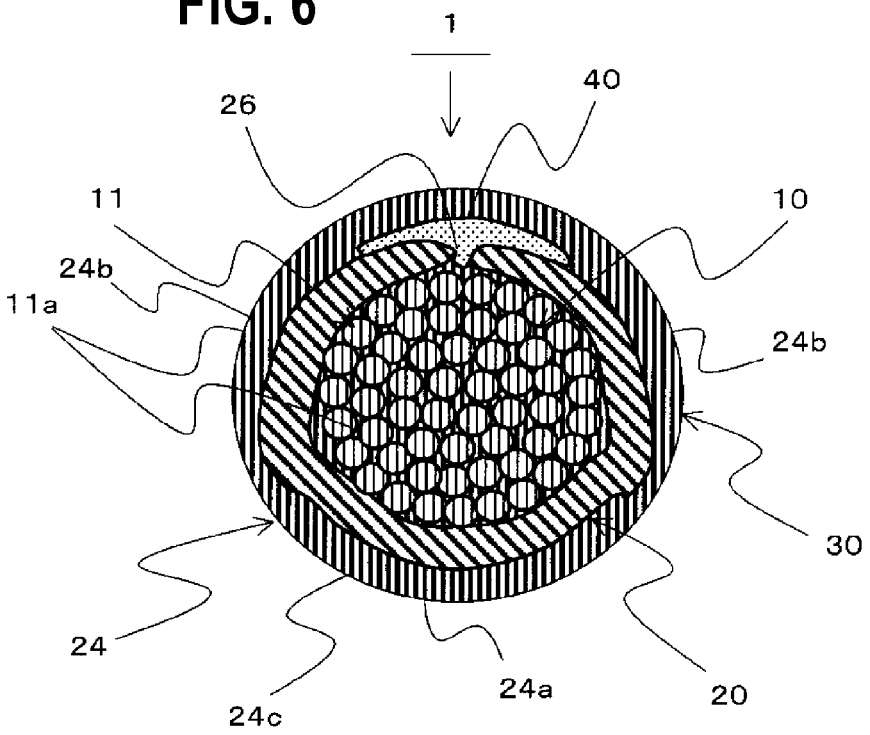
FIG. 6 is a B-B line sectional view of the crimped terminal attached aluminum electric wire shown in FIG. 2.

More specifically, the end side conductor crimping part 24 has an end side conductor crimping bottom wall 24*a* on which the exposed conductor part 11 is placed, and a pair of end side conductor crimping rising walls 24*b* which rise from two side edges of the end side conductor crimping bottom wall 24*a* and which are crimped to surround the upper periphery of the conductor part 11 from the two sides of the exposed conductor part 11. As shown in FIG. 6, the height of the end side conductor crimping rising walls 24*b* is so set that the periphery of the exposed conductor part 11 is surrounded when the pair of upper edges of the pair of end side conductor crimping rising walls 24*b* become a joint.

As shown in FIG. 6, the end side conductor crimping part 24 is crimped to the exposed conductor part 11 at a radial compression rate which is smaller than that at which the conductor part 11 is crimped by the conductor crimping part 23. Therefore, the height of the end side conductor crimping rising walls 24*b* is set to be bigger than the height of the conductor crimping rising walls 23*b*. Thereby, the level difference in the radially outward direction of the aluminum electric wire 10 between the crimped terminal 20 and the insulative coating part 12 is decreased.

In this embodiment, the end side conductor crimping part 24 is crimped to the exposed conductor part 11 so that the outer circumferential surface 24*c* of the end side conductor crimping part 24 becomes flush with the outer circumferential surface 12*b* of the insulative coating part 12 so that the level difference in the radially outward direction of the aluminum electric wire 10 between the crimped terminal 20 and the insulative coating part 12 is controlled as small as possible.

The integrally connecting part 25 has a connecting bottom wall 25*a* which forms the bottom wall of the integrally connecting part 25, whose front end is connected integrally with the conductor crimping bottom wall 23*a*, and whose back end is integrally connected with the end side conductor crimping bottom wall 24*a*, and a pair of connecting side walls 25*b* whose front ends are connected integrally with the pair of conductor crimping rising walls 23*b*, respectively, and whose back ends are connected integrally with the pair of end side conductor crimping rising walls 24*b*, respectively. The front ends and the back ends of the connecting side walls 25*b* are respectively connected to the conductor crimping rising walls 23*b* and the end side conductor crimping rising walls 24*b* whose heights are different from each other. Therefore, the upper edge surfaces of the connecting side walls 25*b* are formed into upward inclined surfaces from the front ends toward the back ends.

When the crimped terminal 20 is crimped to the aluminum electric wire 10, the joint 26 and an opening 27 as the gap 90 of the crimped terminal 20 are sealed by the sealant 40 such as solder.

The sealant 40 is not limited to solder, but, for example, may be synthetic resin such as ultraviolet ray cured resin. It is preferable to use conductive material as the sealant 40 when it is considered to increase electrical resistance as less as possible.

It is also possible that the crimped terminal 20 is a well-known crimped terminal which has the same shape as that of the crimped terminal 20 and whose part corresponding to the end side conductor crimping part 24 is crimped to the insulative coating part 12. In this case, the insulative coating part 12 of the aluminum electric wire 10 is removed so that the exposed width in the extending direction of the conductor part 11 at the end 10*a* gets longer than that of the aluminum electric wire to which a well-known crimped terminal is crimped so that the end side conductor crimping part 24 of the crimped terminal 20 is not crimped to the insulative coating part 12.

Then, the pipe-like elastic sealing member 30 is described.

The pipe-like elastic sealing member 30 is made of elastic material such as silicone rubber, and the pipe inner diameter of the pipe-like elastic sealing member 30 is set to be slightly smaller than the outer diameter of the part covered with the insulative coating part 12 of the aluminum electric wire 10. Therefore, the pipe-like elastic sealing member 30 is adhered to the peripheries of the insulative coating part 12 and the end side conductor crimping part. Therefore, the gap S between the crimped terminal 20 and the insulative coating part 12 in the extending direction of the aluminum electric wire 10 is waterproofably sealed by the pipe-like elastic sealing member 30.

For example, heat shrinkable elastic material may be used for the pipe-like elastic sealing member 30. In this case, by heating the pipe-like elastic sealing member 30 after the pipe-like elastic sealing member 30 is placed at a predetermined position of the aluminum electric wire 10, the coherence performance of the pipe-like elastic sealing member 30 to the aluminum electric wire 10 and the crimped terminal 20 is improved.

Here, steps of assembling the crimped terminal 20 and the pipe-like elastic sealing member 30 to the aluminum electric wire 10 of the crimped terminal attached aluminum electric wire 1 according to the embodiment of the present invention is described by using FIG. 7. FIGS. 7A to 7E are figures which show the steps of assembling the crimped terminal 20 and the pipe-like elastic sealing member 30 to the aluminum electric wire 10 of the crimped terminal attached aluminum electric wire 1 according to the embodiment of the present invention.

Figure 7A:
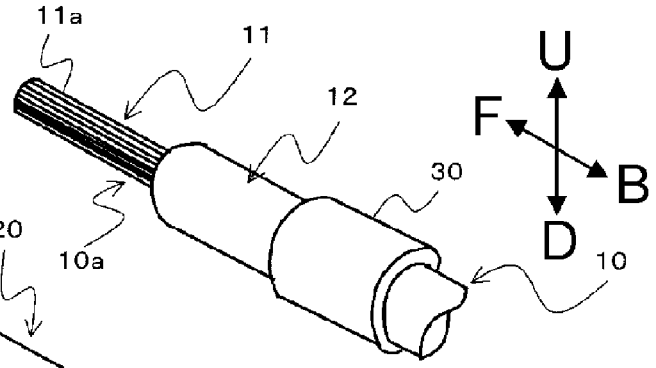
FIGS. 7A to 7E are figures which show steps of assembling a crimped terminal and a pipe-like elastic sealing member to the aluminum electric wire of the crimped terminal attached aluminum electric wire 1 according to the embodiment of the present invention.

First, as shown in FIG. 7A, an operator inserts the aluminum electric wire 10 through the pipe-like elastic sealing member 30, and removes the insulative coating part 12 at the end 10*a* of the aluminum electric wire 10. Here, the pipe-like elastic sealing member 30 is provisionally placed at a position where the attachment of the crimped terminal 20 is not hindered.

Figure 7B:
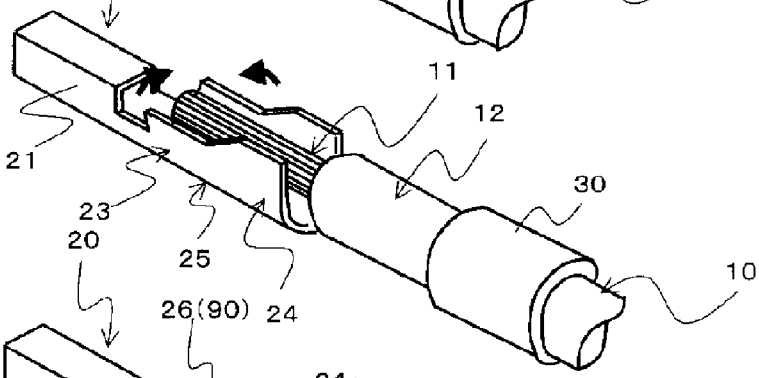
Figure 7C:
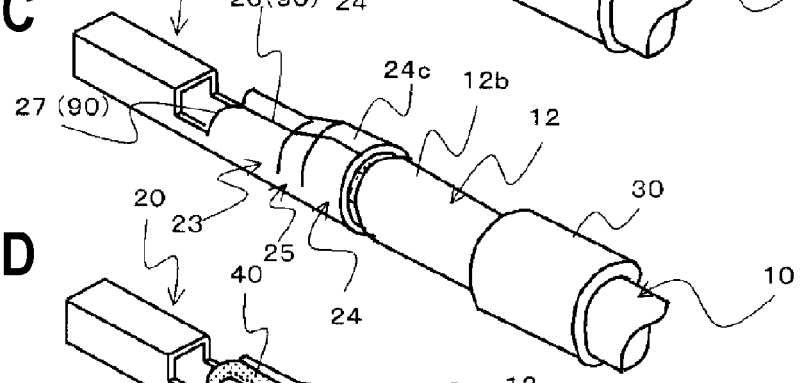

Then, as shown in FIGS. 7B and 7C, the operator crimps the crimped terminal 20 to the aluminum electric wire 10. Here, the crimped terminal 20 is crimped to the aluminum electric wire 10 by using a metal mold not shown. Thereby, the conductor crimping part 23 and the end side conductor crimping part 24 are respectively crimped to the conductor part 11 so that the radial compression rates of the conductor part 11 are different.

Because the conductor crimping part 23 and the end side conductor crimping part 24 are integrally connected through the integrally connecting part 25 without a gap along the extending direction of the aluminum electric wire 10, the crimped terminal 20 is so crimped to align the joint 26 that extends along the extending direction of the aluminum electric wire 10.

Figure 7D:
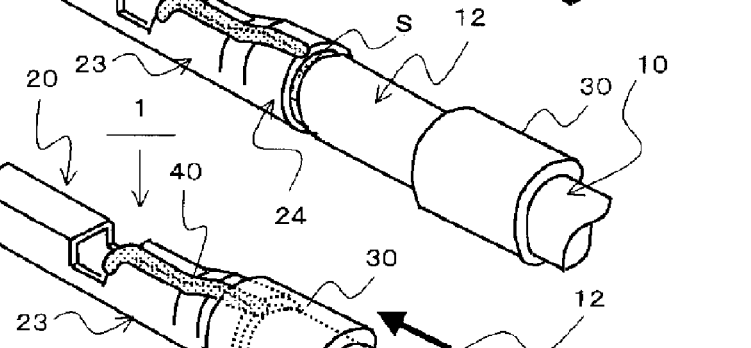

Then, as shown in FIG. 7D, the operator seals the joint 26 and the opening 27 as the gap 90 of the crimped terminal 20, which is crimped to the aluminum electric wire 10, with the sealant 40.

Figure 7E:
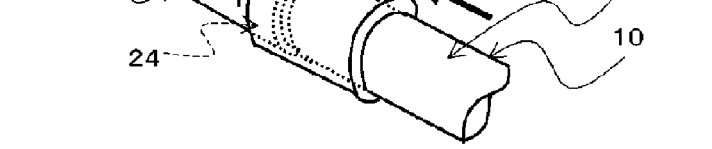

Finally, as shown in FIG. 7E, when the operator moves the pipe-like elastic sealing member 30 to a position to surround the gap S between the crimped terminal 20 and the insulative coating part 12 in the extending direction of the aluminum electric wire 10 along the circumferential direction of the aluminum electric wire 10, the operation of assembling the crimped terminal 20 and the pipe-like elastic sealing member 30 to the aluminum electric wire 10 is completed.

For the crimped terminal attached aluminum electric wire 1 according to the embodiment of the present invention, the level difference between the end side conductor crimping part 24 and the insulative coating part 12 is decreased, the gap S between the crimped terminal 20 and the insulative coating part 12 in the extending direction of the aluminum electric wire 10 is elastically adhered and covered by the pipe-like elastic sealing member 30, and the joint 26 and the opening 27 as the gap 90 of the crimped terminal 20 are sealed by the sealant 40. Thereby, the conductor part 11 is waterproofably sealed inside the crimped terminal 20, and the conductor crimping part 23 is crimped to the exposed conductor part 11. Thus, for the crimped terminal attached aluminum electric wire 1, the crimped terminal 20 is connected to the conductor part 11 without increasing electrical resistance, and since the crimped terminal 20 only includes a part that directly contact the conductor part 11 not through the insulative coating part 12, the size of the crimped terminal attached aluminum electric wire 1 in the radially outward direction is prevented from increasing, and it is not necessary to set the size of a receiving part of the connector housing where the crimped terminal attached aluminum electric wire 1 is received to be big. Thus, as a result, the conductor part 11 is waterproofably sealed inside the crimped terminal 20 without increasing electrical resistance, and there is versatility.

For the crimped terminal attached aluminum electric wire 1 according to the embodiment of the present invention, since the level difference between the end side conductor crimping part 24 and the insulative coating part 12 is controlled as small as possible, it becomes easy for the pipe-like elastic sealing member 30 to be adhered to the crimped terminal 20 and the insulative coating part 12. Thus, waterproofing performance of the pipe-like elastic sealing member 30 can be further improved.

(Variation 1)

Figure 8:
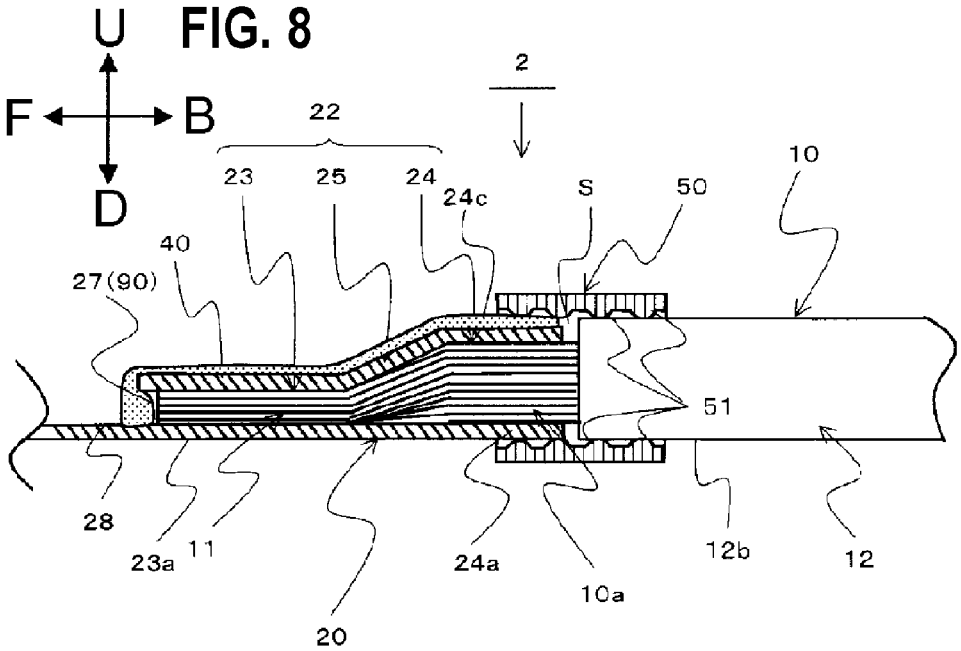
FIG. 8 is a sectional view of a crimped terminal attached aluminum electric wire according to a variation 1 of the embodiment of the present invention which is viewed laterally.

Then, a variation 1 of the crimped terminal attached aluminum electric wire 1 according to the embodiment of the present invention is described by using FIG. 8.

FIG. 8 is a sectional view of a crimped terminal attached aluminum electric wire 2 according to the variation 1 of the embodiment of the present invention which is viewed laterally.

The crimped terminal attached aluminum electric wire 2 of this variation 1 is different from the crimped terminal attached aluminum electric wire 1 of the above embodiment in that there is a pipe-like elastic sealing member 50 in place of the pipe-like elastic sealing member 30.

In addition, other components are the same as those of the above embodiment, and the same symbols as those of the same components of the above embodiment are given.

The pipe-like elastic sealing member 50 is formed with a plurality of lips 51 which are protruded along the pipe inner circumferential surface from the pipe inner surface into a mountain-like shape in section to reduce the pipe inner diameter. By forming the lips 51, water is surely prevented from invading the pipe inside of the pipe-like elastic sealing member 50.

For the crimped terminal attached aluminum electric wire 2 of this variation 1, while the same effect as that of the crimped terminal attached aluminum electric wire 1 according to the above embodiment is achieved, waterproofing performance can be improved since water is surely prevented from invading the pipe inside of the pipe-like elastic sealing member 50.

(Variation 2)

Figure 9:
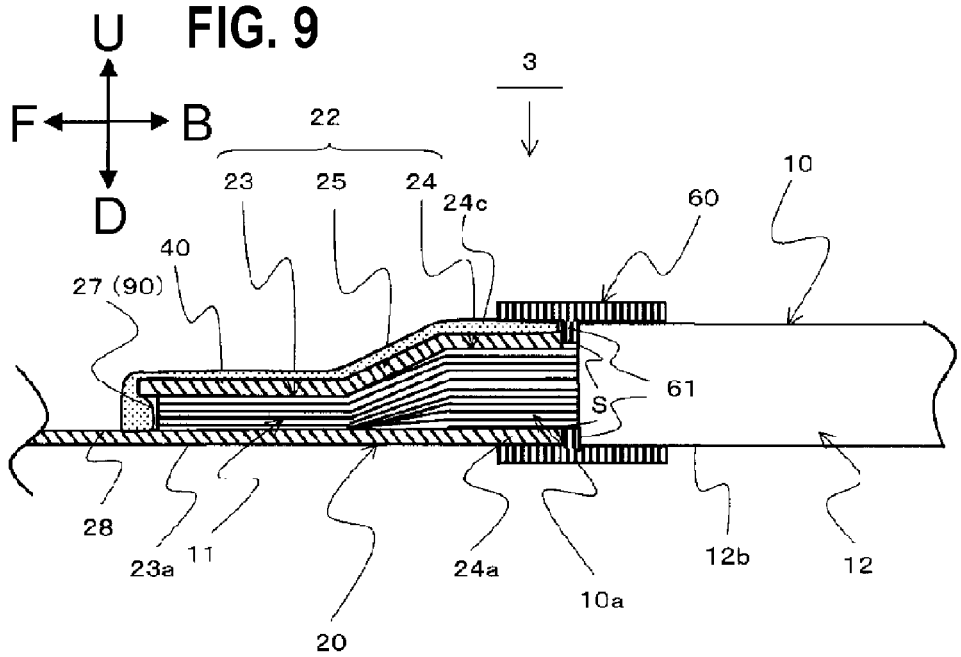
FIG. 9 is a sectional view of a crimped terminal attached aluminum electric wire according to a variation 2 of the embodiment of the present invention which is viewed laterally.

Then, a variation 2 of the crimped terminal attached aluminum electric wire 1 according to the embodiment of the present invention is described by using FIG. 9. FIG. 9 is a sectional view of a crimped terminal attached aluminum electric wire 3 according to the variation 2 of the embodiment of the present invention which is viewed laterally.

The crimped terminal attached aluminum electric wire 3 of this variation 2 is different from the crimped terminal attached aluminum electric wire 1 of the above embodiment in that there is a pipe-like elastic sealing member 60 in place of the pipe-like elastic sealing member 30.

In addition, other components are the same as those of the above embodiment, and the same symbols as those of the same components of the above embodiment are given.

The pipe-like elastic sealing member 60 has a gap fitted protrusion 61 which is protruded from the pipe inner surface to be fitted into the gap S between the crimped terminal 20 and the insulative coating part 12 in the extending direction of the aluminum electric wire 10.

The gap fitted protrusion 61 is formed continuously along the pipe inner circumferential surface of the pipe-like elastic sealing member 60 to fill the gap S when the gap fitted protrusion 61 is fitted into the gap S.

When the gap fitted protrusion 61 is fitted in the gap S, the gap fitted protrusion 61 is caught and the pipe-like elastic sealing member 60 is fixed at a predetermined position of the crimped terminal attached aluminum electric wire 3. Besides, because the gap fitted protrusion 61 is fitted in the gap S, the gap S can be waterproofably sealed surely. Further, even if a bending force is acted, for example, when the crimped terminal attached aluminum electric wire 3 is assembled to a connector housing not shown in the figure, the conductor part 11 is hard to be bent from the gap S as a starting point.

For the crimped terminal attached aluminum electric wire 3 of this variation 2, while the same effect as that of the crimped terminal attached aluminum electric wire 1 according to the above embodiment is achieved, positioning performance, fixing performance, waterproofing performance, and protecting performance against a mechanical external force to the conductor part 11 of the pipe-like elastic sealing member 60 can be improved.

The gap fitted protrusion 61 is not limited to be formed continuously along the pipe inner circumferential surface of the pipe-like elastic sealing member 60. For example, gap fitted protrusions 61 may be formed separately along the pipe inner circumferential surface.

(Variation 3)

Figure 10:
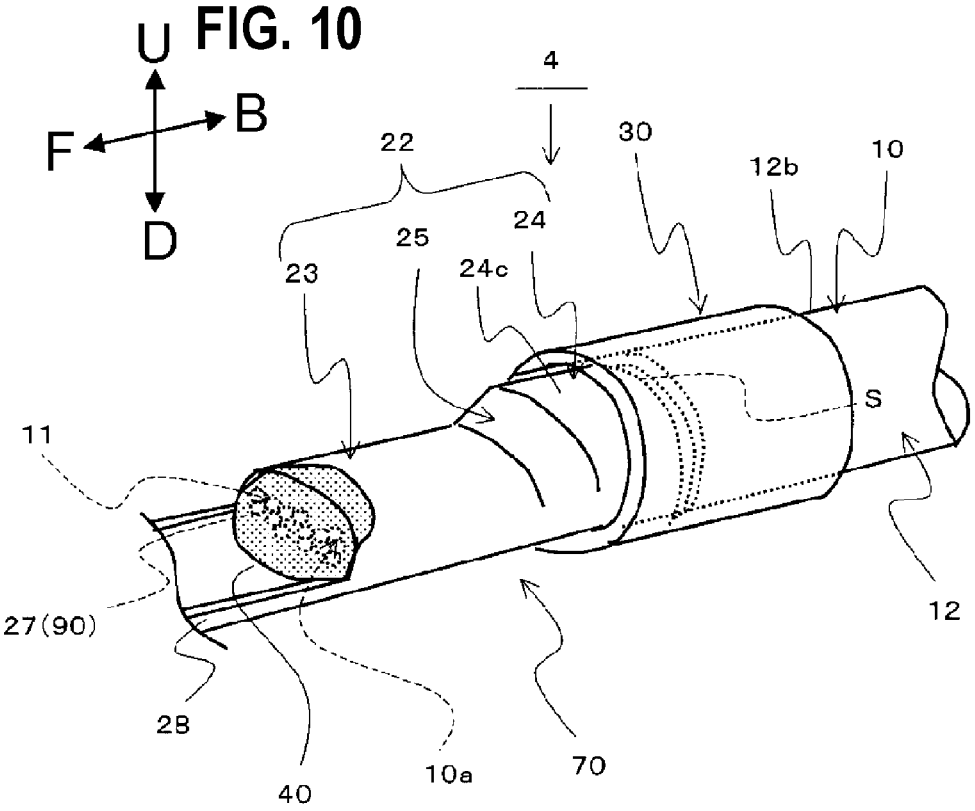
FIG. 10 is a sectional view of a crimped terminal attached aluminum electric wire according to a variation 3 of the embodiment of the present invention which is viewed laterally.

Then, a variation 3 of the crimped terminal attached aluminum electric wire 1 according to the embodiment of the present invention is described by using FIG. 10.

FIG. 10 is a sectional view of a crimped terminal attached aluminum electric wire 4 according to the variation 3 of the embodiment of the present invention which is viewed laterally.

The crimped terminal attached aluminum electric wire 4 of this variation 3 is different from the crimped terminal attached aluminum electric wire 1 of the above embodiment in that there is a crimped terminal 70 in place of the crimped terminal 20.

In addition, other components are the same as those of the above embodiment, and the same symbols as those of the same components of the above embodiment are given.

The crimped terminal 70 is a crimped terminal of the so-called closed barrel type. Therefore, the sealant 40 is only applied to the opening 27 of the crimped terminal 70.

For the crimped terminal attached aluminum electric wire 4 of this variation 3, while the same effect as that of the crimped terminal attached aluminum electric wire 1 according to the above embodiment is achieved, because the part of the conductor part 11 that is exposed from the crimped terminal 70 can be decreased, waterproofing performance of the crimped terminal 70 can be further improved.

(Variation 4)

Figure 11:
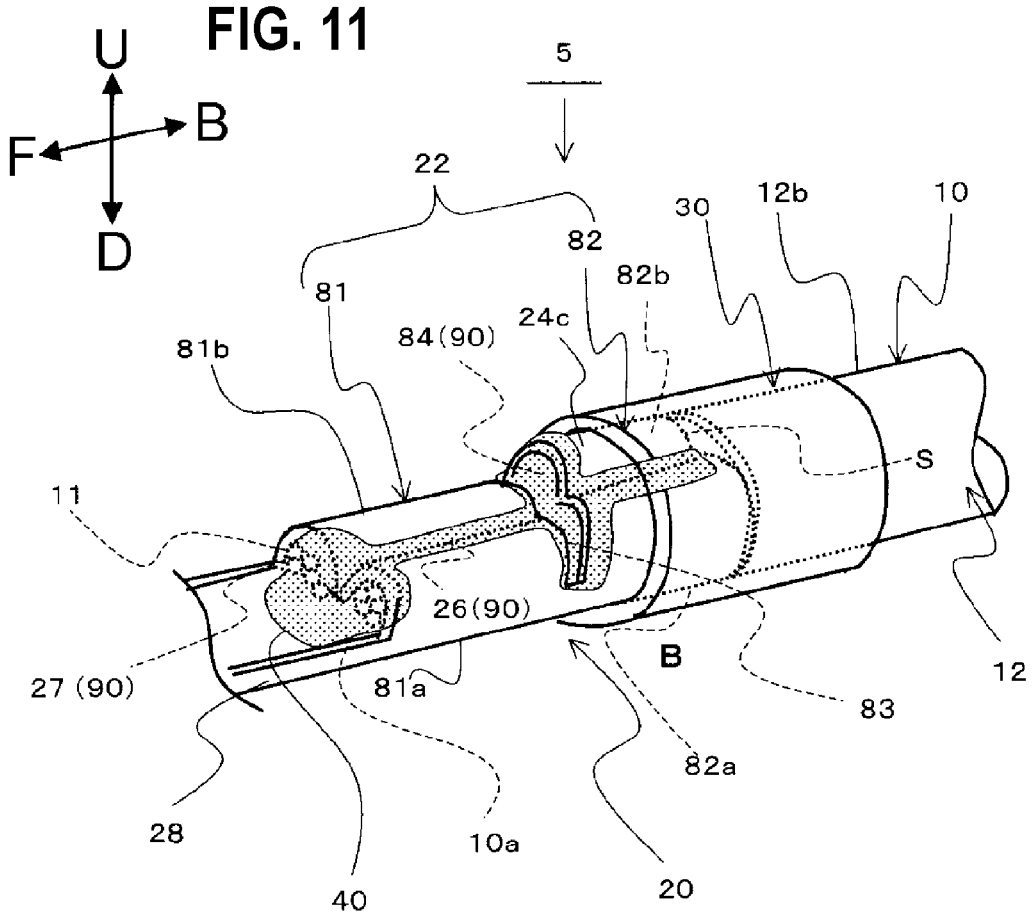
FIG. 11 is a sectional view of a crimped terminal attached aluminum electric wire according to a variation 4 of the embodiment of the present invention which is viewed laterally.
Figure 12:
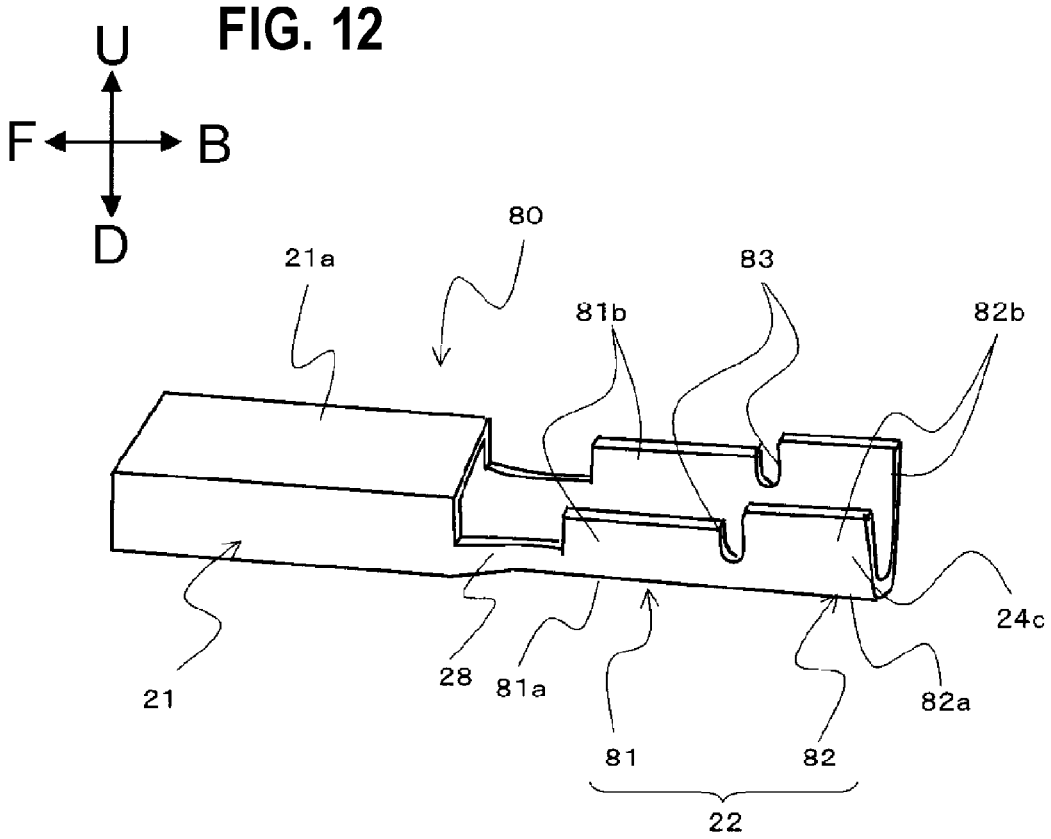
FIG. 12 is an enlarged perspective view of the crimped terminal shown in FIG. 11.

Then, a variation 4 of the crimped terminal attached aluminum electric wire 1 according to the embodiment of the present invention is described by using FIGS. 11 and 12. FIG. 11 is a sectional view of a crimped terminal attached aluminum electric wire 5 according to the variation 4 of the embodiment of the present invention which is viewed laterally. FIG. 12 is an enlarged perspective view of a crimped terminal 80 shown in FIG. 11.

The crimped terminal attached aluminum electric wire 5 of this variation 4 is different from the crimped terminal attached aluminum electric wire 1 of the above embodiment in that there is the crimped terminal 80 in place of the crimped terminal 20.

In addition, other components are the same as those of the above embodiment, and the same symbols as those of the same components of the above embodiment are given.

As shown in FIG. 12, a conductor crimping part 81 of the crimped terminal 80 has a conductor crimping bottom wall 81*a* on which the conductor part 11 is placed, and a pair of conductor crimping rising walls 81*b* which rise from two side edges of the conductor crimping bottom wall 81*a*, and which are crimped to surround the upper periphery of the conductor part 11 from the two sides of the conductor part 11.

Further, an end side conductor crimping part 82 of the crimped terminal 80 has an end side conductor crimping bottom wall 82*a* on which the exposed conductor part 11 is placed, and a pair of end side conductor crimping rising walls 82*b* which rise from two side edges of the end side conductor crimping bottom wall 82*a* and which are crimped to surround the upper periphery of the conductor part 11 from the two sides of the exposed conductor part 11.

As shown in FIG. 12, the crimped terminal 80 is formed with a pair of cut parts 83 which are cut downward from upper edge surfaces between the conductor crimping part 81 and the end side conductor crimping part 82 so that the height of the pair of conductor crimping rising walls 81*b* and the height of the pair of end side conductor crimping rising walls 82*b* can vary greatly.

That is, the crimped terminal 80 does not have the integrally connecting part 25 in the crimped terminal attached aluminum electric wire 1 of the above embodiment. When the crimped terminal 80 is used, an opening 84 as the gap 90 formed by the pair of cut parts 83 is sealed by the sealant 40.

It is also possible that the crimped terminal 80 is a well-known crimped terminal which has the same shape as that of the crimped terminal 80 and whose part corresponding to the end side conductor crimping part 82 is crimped to the insulative coating part 12. In this case, the insulative coating part 12 of the aluminum electric wire 10 is removed so that the exposed width in the extending direction of the conductor part 11 at the end 10*a* gets longer than that of the aluminum electric wire to which a well-known crimped terminal is crimped so that the end side conductor crimping part 82 of the crimped terminal 80 is not crimped to the insulative coating part 12.

The crimped terminal attached aluminum electric wire 5 of this variation 4 plays the same effect as that of the crimped terminal attached aluminum electric wire 1 of the above embodiment.

Here, the features of the crimped terminal attached aluminum electric wires according to the embodiments of present invention described above are briefly, collectively listed as follows, respectively.

[1] A crimped terminal attached aluminum electric wire 1 comprising an aluminum electric wire 10, which includes a conductor part 11 made of aluminum or aluminum alloy and an insulative coating part 12 which surrounds the periphery of the conductor part 11, and a crimped terminal 20 which is crimped to the conductor part 11 which is exposed by removing the insulative coating part 12 at an end of the aluminum electric wire 10, wherein the crimped terminal 20 has a conductor crimping part 23 which is crimped to the exposed conductor part 11 and an end side conductor crimping part 24 which is formed at an end at the side of the crimped terminal 20 to which the aluminum electric wire 10 is connected, and which is crimped to the conductor part 11 at a radial compression rate which is smaller than that at which the conductor part 11 is crimped by the conductor crimping part 23, a gap S between the crimped terminal 20 and the insulative coating part 12 in the extending direction of the aluminum electric wire 10 is surrounded by a pipe-like elastic sealing member 30 along the circumferential direction of the aluminum electric wire 10, and a gap 90 of the crimped terminal 20 which is crimped to the conductor part 11 is sealed by a sealant 40.

[2] The crimped terminal attached aluminum electric wire 1 according to the above [1], wherein the end side conductor crimping part 24 is crimped to the conductor part 11 so that the outer circumferential surface of the end side conductor crimping part 24 becomes flush with the outer circumferential surface of the insulative coating part 12.

[3] The crimped terminal attached aluminum electric wire 3 according to the above [1] or [2], wherein the pipe-like elastic sealing member 60 has a gap fitted protrusion 61 which is protruded from the pipe inner surface to be fitted into the gap S between the crimped terminal 20 and the insulative coating part 12 in the extending direction of the aluminum electric wire 10.

[4] The crimped terminal attached aluminum electric wire 2 according to the above [1] or [2], wherein the pipe-like elastic sealing member 50 is formed with a plurality of lips 51 which are protruded along the pipe inner circumferential surface from the pipe inner surface into a mountain-like shape in section to reduce the pipe inner diameter.

[5] The crimped terminal attached aluminum electric wire 2 according to the above [1] or [2], wherein the end side conductor crimping part 24 is connected integrally with the conductor crimping part 23 along the extending direction of the aluminum electric wire 10 without being separated by a gap (cut part) 83 from the conductor crimping part 23.

The invention accomplished by the inventor is described in detail based on the above embodiments of the invention, but the present invention is not limited to the above embodiments of the invention and can be modified in various ways without departing from the spirit of the invention.

According to the crimped terminal attached aluminum electric wire of the present invention, the crimped terminal is connected to the conductor part without increasing electrical resistance, and since the crimped terminal only includes a part that directly contact the conductor part not through the insulative coating part, the size of the crimped terminal attached aluminum electric wire in the radially outward direction is prevented from increasing, and it is not necessary to set the size of a receiving part of the connector housing where the crimped terminal attached aluminum electric wire is received to be big.

What is claimed is:

1. A crimped terminal attached aluminum electric wire comprising:

an aluminum electric wire that includes a conductor part made of aluminum or aluminum alloy and an insulative coating part which surrounds a periphery of the conductor part; and a crimped terminal that is crimped to the conductor part which is exposed from the insulative coating part at an end of the aluminum electric wire, wherein the crimped terminal includes:

a conductor crimping part which is crimped to the exposed conductor part, and an end side conductor crimping part which is formed at an end at the side of the crimped terminal to which the aluminum electric wire is connected, and which is crimped to the conductor part at a radial compression rate which is smaller than that at which the conductor part is crimped by the conductor crimping part, a gap between the crimped terminal and the insulative coating part in an extending direction of the aluminum electric wire is surrounded by a pipe-like elastic sealing member along a circumferential direction of the aluminum electric wire, and a gap of the crimped terminal which is crimped to the aluminum electric wire is sealed by a sealant.

2. The crimped terminal attached aluminum electric wire according to claim 1, wherein the end side conductor crimping part is crimped to the conductor part so that an outer circumferential surface of the end side conductor crimping part becomes flush with the outer circumferential surface of the insulative coating part.

3. The crimped terminal attached aluminum electric wire according to claim 1, wherein the pipe-like elastic sealing member has a gap fitted protrusion which protrudes from a pipe inner surface to be fitted into the gap between the crimped terminal and the insulative coating part in the extending direction of the aluminum electric wire.

4. The crimped terminal attached aluminum electric wire according to claim 1, wherein the pipe-like elastic sealing member is formed with a plurality of lips which protrude along a pipe inner circumferential surface from a pipe inner surface into a mountain-like shape in section to reduce the pipe inner diameter.

5. The crimped terminal attached aluminum electric wire according to claim 1, wherein the end side conductor crimping part is connected integrally with the conductor crimping part along the extending direction of the aluminum electric wire without being separated by a gap from the conductor crimping part.

6. The crimped terminal attached aluminum electric wire according to claim 2, wherein the pipe-like elastic sealing member has a gap fitted protrusion which protrudes from a pipe inner surface to be fitted into the gap between the crimped terminal and the insulative coating part in the extending direction of the aluminum electric wire.

7. The crimped terminal attached aluminum electric wire according to claim 2, wherein the pipe-like elastic sealing member is formed with a plurality of lips which are protruded along a pipe inner circumferential surface from a pipe inner surface into a mountain-like shape in section to reduce the pipe inner diameter.

8. The crimped terminal attached aluminum electric wire according to claim 2, wherein the end side conductor crimping part is connected integrally with the conductor crimping part along the extending direction of the aluminum electric wire without being separated by a gap from the conductor crimping part.

* * * * *